US005438776A

United States Patent [19]

Lapauw

[11] Patent Number: 5,438,776

[45] Date of Patent: Aug. 8, 1995

[54] INDUSTRIAL IRONING MACHINE AND METHOD FOR MANUFACTURING A BED USED IN SUCH MACHINE

[76] Inventor: Romain Lapauw, Mellestraat 367, 8501 Heule, Belgium

[21] Appl. No.: 71,264

[22] Filed: Jun. 4, 1993

[30] Foreign Application Priority Data

Jun. 5, 1992 [BE] Belgium ..... 09200519

[51] Int. Cl.[6] ..... D06F 65/06

[52] U.S. Cl. ..... 38/47

[58] Field of Search ..... 38/16, 18, 1 R, 44, 38/47, 52, 66, 71, 56; 219/121.6, 121.67, 121.64

[56] References Cited

U.S. PATENT DOCUMENTS

| | | | |
|---|---|---|---|
| 3,118,240 | 1/1964 | D'Hooge | 38/56 |
| 4,223,202 | 9/1980 | Peters et al. | 219/121.63 X |
| 4,418,486 | 12/1963 | Kober | 38/44 X |
| 4,626,653 | 12/1986 | Sciaky et al. | 219/121.63 |
| 4,759,489 | 7/1988 | Pigott | 219/121.63 X |
| 4,787,157 | 11/1988 | Ferrage et al. | 38/47 X |
| 5,022,169 | 6/1991 | Jensen | 38/44 X |

FOREIGN PATENT DOCUMENTS

| | | | |
|---|---|---|---|
| 1235155 | 5/1960 | France . | |
| 0820596 | 7/1949 | Germany | 38/44 |
| 3507168 | 9/1986 | Germany | 38/44 |
| 0213552 | 1/1989 | Germany | 38/44 |
| 0263553 | 1/1989 | Germany | 38/44 |
| 2088416 | 6/1982 | United Kingdom | 38/18 |
| 8503313 | 8/1985 | WIPO | 38/44 |

*Primary Examiner*—Clifford D. Crowder
*Assistant Examiner*—Ismael Izaguirre

[57] ABSTRACT

An industrial ironing machine comprising an ironing cylinder and a bed extending substantially around half of this ironing cylinder, characterized in that the bed of the industrial ironing machine is composed of flexible stainless steel plates (1, 2) having besides a laser weld (4) along the circumference a series of welded spots (5) obtained by the laser technique.

4 Claims, 2 Drawing Sheets

INDUSTRIAL IRONING MACHINE AND METHOD FOR MANUFACTURING A BED USED IN SUCH MACHINE

FIELD OF THE INVENTION

The present invention relates to an industrial ironing machine comprising an ironing cylinder and a bed extending substantially around half of this ironing cylinder.

BACKGROUND OF THE INVENTION

In industrial ironing machines of the described type, the ironing cylinder is surrounded over substantially half of its circumference, in certain cases over two-thirds thereof, by a bed which is usually heated up to the required temperature by steam for drying and ironing the goods introduced between this bed and the ironing cylinder.

The beds of such ironing machines are always composed of a heavy steel plate which has to fit closely to the ironing cylinder. In order to allow this, the inner wall of the half-cylindrically shaped bed has to be milled and finished with the utmost care.

Beds manufactured in this way have to be milled and finished carefully due to the stresses caused by the welding process so as to guarantee the required extremely smooth finishing of the inner wall of the bed.

In the French patent No. 1,235,155 these drawbacks are already indicated and proposes therefore to realize a bed designated as light, an essential characteristic of which being the indeformability of this component.

The object thereof is clearly to realize a saving of weight. Due to the still relatively large thickness of the beds manufactured according to this invention and the applied conventional welding technique, the inner wall of these beds has to be subjected to the hereabove mentioned milling operations.

SUMMARY OF THE INVENTION

An object of the invention is now to design an industrial ironing machine, the bed of which offers at least the following advantages distinguishing this component of the ironing machine clearly from that according to said French patent:

1. Large flexibility or deformability, which means that the bed adapts itself continuously to the ironing roller and to its clothing which is subjected to wear.
2. No finishing process of the inner wall is required.
3. A maximally performed weight reduction so that the components responsible for maintaining the necessary pressure between ironing roller and bed are less loaded.

In order to enable this according to the invention, the bed of the industrial ironing machine is composed of flexible stainless steel plates having a laser weld along the circumference and a series of welded spots so that both plates are connected to one another along their edges and locally, and both the weld and the welded spots are obtained by laser welding.

Still according to the invention, the plate which engages in the operative position the ironing cylinder, has a thickness of between 3 and 5 mm, while the plate which is situated in the operative position on the outer side, has a thickness of between 0.80 and 1.20 mm.

As explained in the preamble, the invention also relates to the method for manufacturing a bed to be used in combination with the ironing cylinder of an industrial ironing machine according to the invention. This method is mainly characterized in that these plates are joined along their circumference by a weld obtained through the laser technique and are further mutually connected by welded spots, which welded spots are also obtained by the laser technique, and finally the plate of the smallest thickness is deformed by injection of water under pressure until a spacing of about 2 mm is realized between both plates.

Other details and advantages of the invention will become apparent from the following description of an industrial ironing machine and the method for manufacturing a bed for use in such an ironing machine according to the invention. This description is only given by way of example and does not limit the scope of the invention. The reference numerals relate to the annexed figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT(S)

The bed shown by the different figures is a bed pertaining to an ironing machine, the ironing cylinder of which has a large diameter. By large diameter, there is meant a diameter comprised between about 600 and 1600 mm. The problem with such large ironing cylinders consists in obtaining a close fitting of the bed around the ironing roller. A close fitting of these two components is a clear requisite for obtaining a correct functioning of the machine. During its functioning, the clothing of the ironing roller is subject to wear. This wear, especially when it is locally more pronounced for one reason or another, is the origin of serious difficulties. Such problems regularly arise with beds having a high rigidity and a lack of deformability.

The hereabove described drawbacks of beds used in ironing machines of large diameters can now be obviated by designing a bed which is formed by connecting two thin plates. By thin plates there are meant plates having a thickness of about 1 mm for the plate 1 which is situated in the operative position on the outer side of the bed, and a thickness of about 4 mm of the plate 2 which, also considered in the operative position, engages the ironing roller 3.

Figure 3:
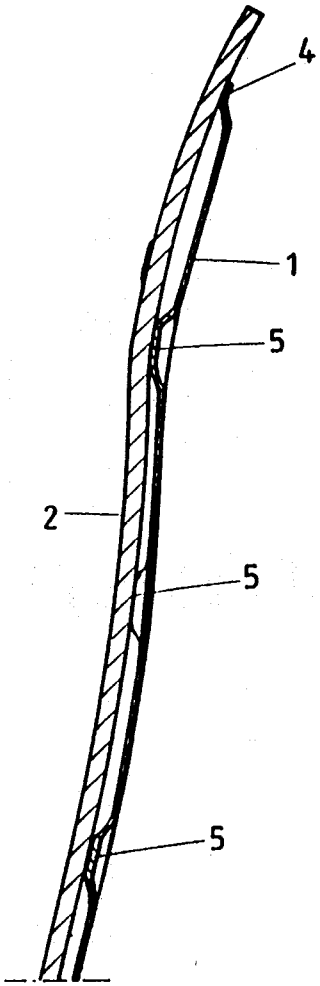
FIG. 3 is a cross-section according to line III—III of FIG. 2.
Figure 2:
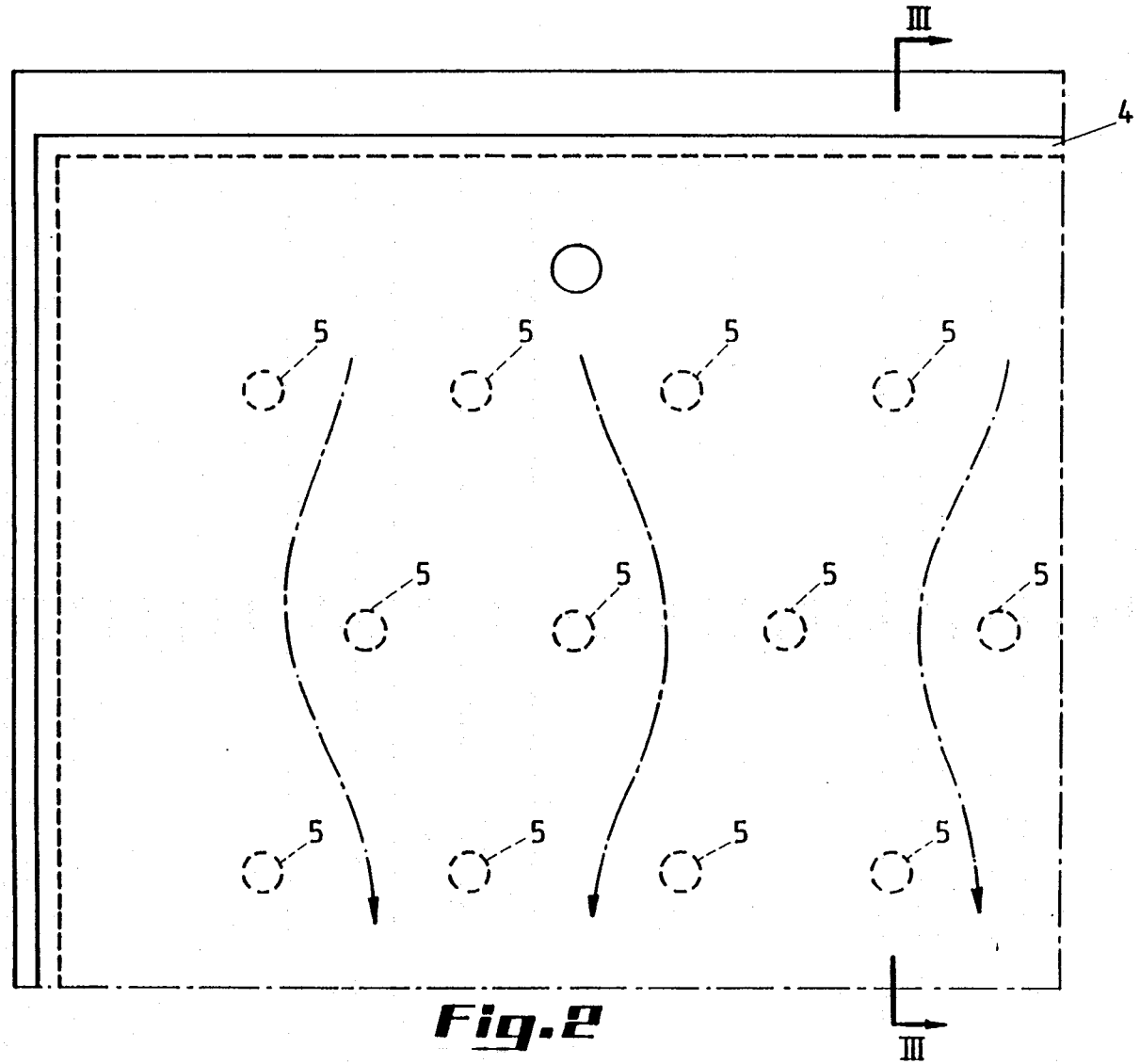
FIG. 2 shows schematically a possible distribution of the welded spots between both plates pertaining to the bed according to the invention.

The method for manufacturing the bed according to the invention consists in superimposing the plates 1 and 2 in a flat position and connecting them to one another by a laser weld 4 along the circumference and connecting them further locally to one another also by making use of a laser beam and this according to an arbitrary pattern. FIGS. 2 and 3 show a series of such welded spots 5.

Figure 1:
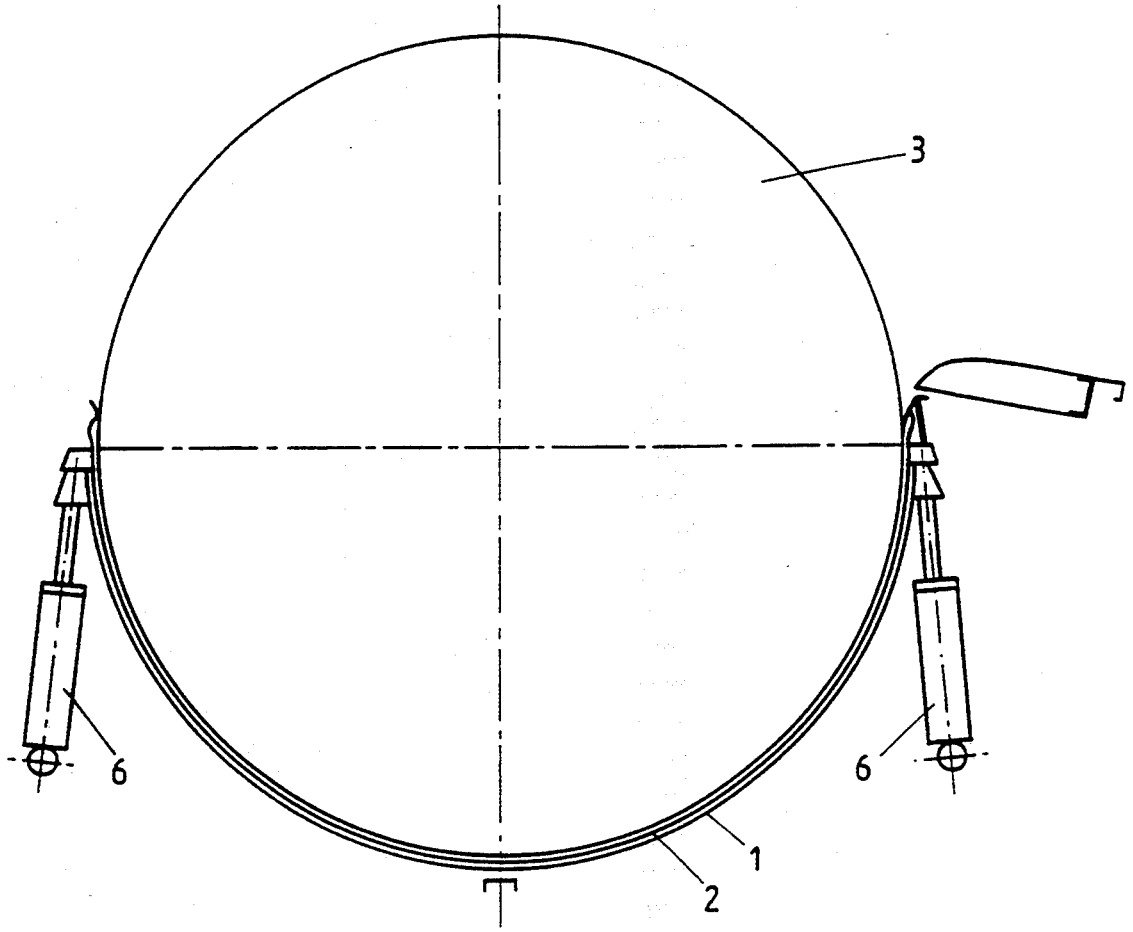
FIG. 1 is a schematically shown side elevational view of the ironing cylinder together with the bed pertaining thereto and means for keeping the bed pressed against the ironing cylinder.

After having applied the different welded spots 5 by making use of the laser beam, a pressure is built up to about 30 bars by injection of pressurized water between the plates 1 and 2, so that the thinner plate 1 will deform whereas the plate 2 maintains its continuous cross-profile. Between the different welded spots 5, flow channels for the circulating fluid, usually steam, are formed. The distance between the plates 1 and 2 comprises about 2 mm and composes the actual steam chamber. The plates 1 and 2 connected to one another in this way constitute a flexible entity which can be raised and be maintained in a position wherein they are pushed against the outer wall of the ironing cylinder by hydraulic jacks 6 (FIG. 1).

Due to the flexibility of the plates composing the bed, this bed will closely fit against the ironing cylinder itself on the inner side, i.e. on the side of the plate 2, and this notwithstanding deformation or wear of the clothing of the ironing roller.

The advantages of the bed described within the scope of this invention can be summarized as follows:

a) the construction of the bed is simple and cheap due to the complete omission of the technically complicated operations for milling a bed consisting of a heavy, or in anyway considerably more heavy plate than represented here, b) due to the connection of the thin and flexible plates trough the laser beam technique, deformations of the outer surface of the plate 2 are avoided, which plate remains in operation always nicely in contact with the ironing cylinder 3 and this, as already emphasized hereinabove, notwithstanding possible wear or local deformations of this component. Connecting plates having a thickness in the range of 7 to 15 mm by spot welding generates stresses and therefore deformations which require expensive and time consuming milling operations. This is a very remarkable advantage since the milling operations can be omitted entirely.

c) The efficiency of the bed according to the invention can therefore be considered as being very high and reliable due to the remaining and perfect fitting of the bed against the ironing roller;

d) the heat transfer through a stainless steel plate having a thickness of about 4 mm is considerably better than through a steel plate of a conventional bed having a thickness of about 15 mm;

e) due to the very small steam content, the circulation of the hot steam does not raise the problems which are proper to wider steam chambers.

From the hereabove given description of the ironing machine according to the invention and of the method for manufacturing the bed thereof, it appears that a flexible deformable bed which adjusts itself always to the ironing roller can be manufactured by making use of steel plates which may be considered in the relevant field as having a very small thickness. Also the welding technique suggested for this application has for result that every after treatment of the flexible bed becomes superfluous.

The invention is not limited to the hereabove described embodiment and many modifications could be applied thereto without leaving the scope of the patent application.

What is claimed is:

1. An industrial ironing machine comprising:

an ironing cylinder;

a flexible bed extending substantially around half of said ironing cylinder, said flexible bed being composed of two flexible stainless steel plates having a laser weld along a circumference of said steel plates and a series of welded spots obtained by a laser technique, wherein one of said flexible stainless steel plates, which engages the ironing cylinder in an operative position, has a thickness of between 3 and 5 mm, and a second one of said flexible stainless steel plates, which is situated in an operative position away from said ironing cylinder, has a thickness of between 0.80 and 1.20 mm; and means for keeping the flexible bed pressed against the ironing cylinder.

2. The industrial ironing machine as in claim 1, wherein a space is formed between said two flexible stainless steel plates by injection of fluid under pressure between the plates until a spacing of about 2 mm is realized between both plates.

3. A method for manufacturing a bed to be used in combination with an ironing cylinder of an industrial ironing machine, said method comprising the steps of:

providing two stainless steel plates one of said plates having a thickness of between 0.80 and 1.20 mm, and the other of said plates having a thickness of between 3 and 5 mm respectively;

joining said plates along a circumference of said plates by a laser weld and further mutually connecting said plates by welded spots, which welded spots are also obtained by a laser technique; and finally deforming the plate of the smallest thickness by injection of water under pressure between said plates until a spacing of about 2 mm is realized between both plates.

4. The method as in claim 3, wherein pressurized water is injected between both plates until a pressure of about 30 bars is achieved between said plates.

* * * * *